US010391794B2

(12) United States Patent
Janssen et al.

(10) Patent No.: US 10,391,794 B2
(45) Date of Patent: Aug. 27, 2019

(54) DEFECT DETECTION FOR PRINT MEDIA

(71) Applicant: Océ Holding B.V., Venlo (NL)

(72) Inventors: Cornelius Janssen, Venlo (NL); Leon C. Van Breugel, Venlo (NL); Ken A. G. Boonen, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/111,422

(22) Filed: Aug. 24, 2018

(65) Prior Publication Data

US 2019/0070870 A1 Mar. 7, 2019

(30) Foreign Application Priority Data

Sep. 1, 2017 (EP) ..... 17189032

(51) Int. Cl.
*B41J 13/00* (2006.01)
*B41J 11/00* (2006.01)

(52) U.S. Cl.
CPC ..... *B41J 13/0009* (2013.01); *B41J 11/0095* (2013.01); *B41J 13/0027* (2013.01)

(58) Field of Classification Search
CPC ..... B41J 13/0009; B41J 11/0095; B41J 13/0027; B41J 29/393
USPC ..... 347/14, 16, 19, 101, 104
See application file for complete search history.

(56) References Cited

U.S. PATENT DOCUMENTS 8,419,144 B2 4/2013 Castillo et al.
2011/0279507 A1 11/2011 Castillo et al.
2016/0009516 A1* 1/2016 Mark ..... B31F 1/2831 493/13
2016/0103633 A1* 4/2016 Huijbers ..... B41J 13/0009 347/16

FOREIGN PATENT DOCUMENTS

WO WO 2016/055501 A1 4/2016

OTHER PUBLICATIONS

European Search Report, dated Nov. 23, 2018, for European Application No. 18190067.
European Search Report issued in European Application No. 17189032, dated Mar. 9, 2018.

* cited by examiner

*Primary Examiner* — Jannelle M Lebron
(74) *Attorney, Agent, or Firm* — Birch, Stewart, Kolasch & Birch, LLP

(57) ABSTRACT

A duplex sheet printer comprising a first and second sheet quality detection device for determining a suitability of a sheet for printing. The first sheet quality detection device applies a first sheet rejection threshold to which sensed sheets are compared, while the second sheet quality detection device applies a second sheet rejection threshold different from the first. The controller designates sheets in the printing system to be sensed by one of the sheet quality detection devices in accordance with the sheet's media type or the sheet being on a simplex or duplex pass. Different rejection criteria are thus applied to the sheets without adjustment of a sheet quality detection device, resulting in high speed printing.

15 Claims, 5 Drawing Sheets

DEFECT DETECTION FOR PRINT MEDIA

FIELD OF THE INVENTION

The present invention generally pertains to a printing system, an apparatus for defect detection in a printing system, and a method for detecting defects in a printing system.

BACKGROUND ART

One or more deformations present within a sheet of a medium to be printed can cause serious reliability problems in a printing system, such as an inkjet printing system, where there is only a small gap between a sheet transport mechanism and an image forming device or printing head of the printing system. If the sheet to be printed touches the image forming device or the printing head as a result of such a deformation, this can lead to print quality degradation and/or to a sheet jam in the machine. To achieve high print quality in an inkjet printing system, the distance between the printing heads and sheet to be printed should be kept small. Because of this small distance (print gap) the print heads are easily touched by the sheets as they pass. Accordingly, even small defects like dog ears, wrinkles, tears etc. can cause a so-called "head touch", which can degrade print quality, cause nozzle failure, or even sheet jams.

To address these issues, systems have been developed which employ a proofing device capable of identifying sheet deformations and rejecting sheets that contain such deformations. U.S. Pat. No. 8,419,144 B2 discloses such a proofing device, wherein multiple emitters are positioned alongside a transport path of the printing system, such that the emitters emit optical beams over the surface of the medium. A deformation in the sheet may then be detected as it passes through one or more of the beam by a corresponding drop in the detected intensity. Drawback of the known proofing device is its incapability to distinguish between different sheet types, especially when these sheets are applied as a continuous stream. The same rejection criterion is applied to all sheets. The accuracy of the defect detection is thereby reduced, as the rejection criteria cannot be attuned to the specific conditions of a sheet, for example to its media type or prior processing of said sheet, without interrupting the printing process.

SUMMARY OF THE INVENTION

It is an object of the present invention to provide a productive and accurate apparatus and method for detecting deformations in sheets in a printing system.

Thereto, the present invention provides a printing system according to claim 1 and a method according to claim 13.

In a first aspect, the present invention provides an apparatus for defect detection in a sheet printing system, the apparatus comprising:

- a sheet sensing transport path;
- a first and a second sheet quality detection device positioned along the sheet sensing transport path and configured for sensing sheets on the sheet sensing transport path, the first and second sheet quality detection devices defining respectively a first and a second sheet rejection threshold to which a sensed sheet is compared for determining its suitability for printing;
- a controller configured to designate each sheet in a print job on each pass of a sheet over the sheet sensing transport path to one of the first and the second sheet quality detection devices, such that each sheet is sensed by its designated one of the first and the second sheet quality detection devices.

At least two sheet quality detection devices are positioned along the sheet sensing transport path, such that a sheet on the sheet sensing transport path is sensed by one of the two sheet quality detection devices. Each sheet quality detection device comprises its own predetermined sheet rejection threshold to which the sensed sheets are compared to determine their suitability for printing. Each sheet quality detection device is configured to generate a signal or data for a sensed sheet. Said signal or data is compared to the respective sheet rejection threshold. In case the signal is determined to be on the undesired side of the sheet rejection threshold, the controller determines the sheet as unsuitable for printing. The sheet may then be removed from the transport path manually, but preferably by a sheet removal device.

Having at least sheet quality detection devices enables the controller to set two different sheet rejection thresholds. This is advantageous when sheets with different properties pass alternatingly and at high speeds along the apparatus for defect detection. The controller controls the first sheet quality detection device to apply the first rejection threshold to a first type of sheets, while the second sheet quality detection device is controlled to compare sheets of a second type to the second sheet rejection threshold. This enables more accurate quality detection as the rejection criteria may be set specifically for a certain sheet type. The different sheet types may distinguish themselves by the sheet being unprinted or one-sided printed, by the print media material, or by the sheet thickness. One type may require stricter rejection criteria than another type, because the first type is more prone to deformation or because its route through the printing system is different from the other type. A common example may be a duplex printer where stricter rejection criteria are preferably applied for simplex type sheets (unprinted sheets which still require printing on both sides) compared to duplex type sheets (one-side printed sheets which only have one side to be printed remaining), as the simplex sheet has a substantially longer way to travel through the printing system than the duplex sheet which is output after printing. It is the insight of the inventors that by selectively sensing the different sheet types by one of two or more sheet quality detection devices, each with its own individual sheet rejection threshold, different refection criteria may be applied to the different sheet types without requiring adjustments of a sheet quality rejection device in between two consecutive sheets. Thereby, a high productivity may be achieved as the delay needed for adjusting a sheet rejection threshold is eliminated. As such, the object of the present invention is achieved.

More specific optional features of the invention are indicated in the dependent claims.

In an embodiment, during use the first sheet rejection threshold is set different from the second sheet rejection threshold. The first sheet quality detection device's sheet rejection threshold is different from that of the second sheet quality detection device. At the start of a print job, the controller sets the different values or levels of the sheet rejection thresholds. In consequence, the first sheet quality detection device applies stricter rejection criteria than the second sheet quality detection device or vice versa. For example, the sheet rejection threshold may be a threshold height, corresponding to a maximum allowed distance from the plane of the sheet sensing transport path measured perpendicular thereto. The controller sets the first threshold height above or below the second threshold height. The controller then assigns sheets of a first type to the first sheet quality detection device, which compares these sheets to the first threshold height. Sheets of a second type are assigned to be sensed by the second sheet quality detection device and compared to the second threshold height.

In another embodiment, the first and second sheet quality detection devices comprise respectively a first and a second threshold setting actuator for adjusting and setting respectively the first and second sheet rejection thresholds independently of one another. Upon receiving print job settings, the controller based on said settings sets the sheet rejection thresholds by controlling the actuators. The actuators are preferably height adjustment actuators for moving a support in a direction perpendicular to the sheet sensing transport path. Preferably an optical emitter is mounted on the support, though alternatively a deformation contact plate or flag may be applied within the scope of the present invention. In the case of the optical emitter, the controller controls the actuator to set the emitter to emit a beam at a substantially constant height distance over the sheet sensing transport path for each sheet quality detection device. The first emitter's beam then extends at a first height above or below the second emitter's beam. The controller then controls the sheet quality detection devices such that sheets of a first type are exposed to the first beam of the first emitter while sheets of the second type are exposed to the second beam of the second emitter. The actuators enable the apparatus to set the appropriate thresholds based on the print job settings without operator interference.

In a further embodiment, the controller is configured to disable one of the first and the second sheet quality detection devices when the other one of the first and the second sheet quality detection devices senses a sheet to which said other one of the first sheet and a second quality detection devices is designated. To avoid the double sensing of a single sheet, the controller controls the sheet quality detection devices such that a sheet is sensed only by a single one of the sheet quality detection devices. When sensing a first sheet of a first type or in a first state, the controller activates and controls the first sheet quality detection device to sense the first sheet, while sensing of said sheet by the second sheet quality detection device is prevented. The situation is preferably reversed when sensing a second sheet of a second type, such that said sheet is sensed only by the second sheet quality detection device. Thereby erroneous deformation detection while sensing the sheet with both sheet quality detection devices is prevented. This embodiment is particularly advantageous when the sheet quality detection devices comprise optical emitters. By disabling the emitter of the sheet quality detection not designated for a specific sheet, no light from said disabled detector is scattered onto a detector, improving the accuracy of the apparatus according to the present invention.

In an embodiment, the controller is configured to determine a sheet state parameter for each sheet for each pass of said sheet over the sheet sensing transport path, and wherein the controller designates the one of the first and second sheet quality detection devices based on said sheet state parameter. The sheet state or type parameter uniquely assigns a respective sheet to one of the sheet quality detection devices. The state or type of a sheet may change during its transport through the printing system. For example the sheet is in a different state, namely unprinted, on its simplex pass as compared to the same sheet on the duplex pass, wherein the one of the sides of the same sheet has printed on. Each sheet for each image to be printed on it is thus assigned a different sheet state parameter. In other words, each side of each sheet is assigned a sheet state parameter. In consequence, the sensed sheet is compared to different sheet rejection thresholds on the first and the second pass along the apparatus according to the present invention. The controller during operation determines a sheet queue describing the order in which sheets are transported over the sheet sensing transport path. Each sheet item in the sheet queue corresponds to a side of a sheet. The controller determines for each sheet item in the queue its sheet state parameter. Sheets with the same sheet state parameter are designated to be scanned by the same one of the sheet quality detection devices.

In a preferred embodiment, the sheet state parameter comprises:

- a simplex-duplex parameter corresponding to the respective sheet being on a simplex pass or duplex pass of the printing system; and/or
- a media type parameter corresponding to the media type of the respective sheet.

The controller may derive the sheet state parameter e.g. from the sheet's position in the printing system or from the media type of the sheet. Sheets on their simplex pass, e.g. unprinted sheets, are assigned to be sensed by the first sheet quality detection device, while sheets on their duplex pass, e.g. one-side printed sheets, are designated for sensing by the second sheet quality detection device. Alternatively, sheets of different media types are assigned different sheet type or state parameters. The present invention is particularly advantageous for a duplex printer which interleaves simplex and duplex sheets on its transport path. The simplex and duplex sheets therein travel at high speeds in an alternating order through the apparatus for defect detection.

In another embodiment, the first and the second sheet quality detection devices comprise respectively a first and a second emitter for emitting respectively a first and a second emission signal towards a sheet on the sheet sensing transport path. The emission signals are preferably beams extending over the sheet sensing transport path parallel thereto. The beams extend from one side of the sheet sensing transport path to the opposite lateral side. Each emitter is set to emit its beam at a specific height from the sheet sensing transport path. The heights of the beams differ such that two different sheet rejection threshold heights are defined by the height position of each emitter.

In another embodiment, the first and the second emitters are configured for emitting respectively the first and the second emission signals parallel to a plane of the sheet sensing transport path.

In a further embodiment, the first and second threshold setting actuators are configured to adjust a height of respectively the first and the second emitter perpendicular to the plane of the sheet sensing transport path. The controller sets the sheet rejection threshold height before starting the print job by moving the emitters to their respective heights. During operation, the emitters are positioned at different heights. In an embodiment, the controller may adjust the height of a first actuator for a first emitter while the second emitter on the second actuator is sensing a sheet and/or vice versa. Thereby, sheet rejection thresholds may be adjusted during printing.

In a preferred embodiment, the apparatus according to the present invention further comprises a sensor assembly extending laterally over the sheet sensing transport path. The sensor assembly is for example a page-wide array of light sensitive detectors, such as photosensitive diodes. The first sheet quality detection device is formed by the first emitter and the sensor assembly, while the second sheet quality detection device is formed by the second emitter and the sensor assembly. By utilizing the same sensor assembly for both sheet quality detection devices a compact and cheap apparatus is achieved.

In an embodiment, the apparatus according to the present invention further comprises a sensor assembly positioned with respect to the first and the second emitter such that:

the first and/or the second emission signals is prevented from reaching the sensor assembly when the sheet is suitable for printing; and at least part of the first and/or the second emission signals is reflected from the sheet to the sensor assembly when a deformation in the sheet exceeds respectively the first and/or the second sheet rejection threshold.

The sensor assembly generates an intensity signal, which when exceeding a respective sheet rejection threshold setting classifies the sheet being sensed as unsuitable for printing. A sheet is thus only rejected when sufficient light reaches the detector in contrast to known prior art devices which look for a drop in the continuously measured light intensity to determine a sheet deformation. The minimum light intensity of the present invention leads to a more accurate apparatus, as one need continuously filter out variations in the light intensity due to vibrations or ambient conditions.

In another embodiment, the apparatus according to present invention further comprises:

a processor to determine the suitability of the sheet for printing from sensor data generated by a sensor assembly and representative of a deformation in the medium;

wherein the controller is configured for controlling further progress of the sheet along the transport path in dependence of the determined sheet's suitability for printing;

a removal device for removing the sheet from the transport path of the printing system, wherein the controller is configured to control the removal device to remove the sheet from the transport path if the processor determines the sheet to be unsuitable for printing. The sheet removal device may be a switch for directing sheet onto a reject transport path towards a rejected sheet holder. The switch is downstream of the apparatus for defect detection. The controller operates the switch when a sensed sheet is qualified as unsuitable for printing by comparison of the data from the sensor assembly to the respective sheet rejection threshold.

In a further aspect, the present invention provides a printing system comprising the apparatus according to the present invention as well as a simplex pass for first-sided printing of sheets and a duplex pass for second-sided printing sheets, wherein the controller is configured to designate sheets on their simplex pass to the first sheet quality detection device and to designate sheets on their duplex pass to the second sheet quality detection device, such that the sheets are sensed by their designated sheet quality detection device.

In a further aspect, the present invention provides a method for detecting defects in sheets in a printing system, comprising a first and a second sheet quality detection device positioned along the sheet sensing transport path and configured for sensing sheets on the sheet sensing transport path of the printing system, the first and second sheet quality detection devices defining respectively a first and a second sheet rejection threshold, the method comprising the steps of:

designating a first sheet in a first state to the first second quality detection device;

the first sheet quality detection device sensing the first sheet;

designating a second sheet in a second state different from the first state to the second sheet quality detection device; and the second sheet quality detection device sensing the second sheet.

Thereby, sheet in the first state or of the first type are sensed by the first sheet quality detection device, which applies as rejection criteria the first sheet rejection threshold. Sheet of the second type are sensed by the second sheet quality detection device, which compares the sensed second type sheets to the second sheet rejection threshold. The first and second sheet quality detection devices apply different rejection criteria to the sheet assigned to them by the controller. No active threshold adjustment is required, resulting in high productivity printing with accurate defect detection.

In an embodiment, the method according to the present invention further comprises the steps of:

comparing the sensed first sheet to the first sheet rejection threshold to determine whether the first sheet is suitable for printing;

comparing the sensed second sheet to the second sheet rejection threshold to determine whether the second sheet is suitable for printing; and ejecting sheets deemed unsuitable for printing from a transport path of the printing system. Sheets of the first type (e.g. simplex sheets or of a first media type) are compared to the first sheet rejection threshold. Sheets of the second type (e.g. simplex sheets or of a first media type) are compared to the second sheet rejection threshold. If the comparison yields that a respective sheet is unsuitable for printing, the sheet is removed from the transport path, preferably by a sheet ejector device.

In another embodiment, the method according to the present invention further comprises the steps of:

inputting print job settings to a controller; and the controller controlling a first and a second threshold setting actuator to set respectively the first and the second sheet rejection threshold of respectively the first and the second sheet quality detection device.

The controller thus automatically sets the first and second sheet rejection thresholds by moving their respective actuators based on the print job settings. Thereby, the sheet rejection criteria for each sheet rejection device may be adjusted to e.g. the media type applied in the print job. No operator interference is required.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying schematical drawings which are given by way of illustration only, and thus are not limitative of the present invention, and wherein.

DETAILED DESCRIPTION OF THE DRAWINGS

Figure 1:
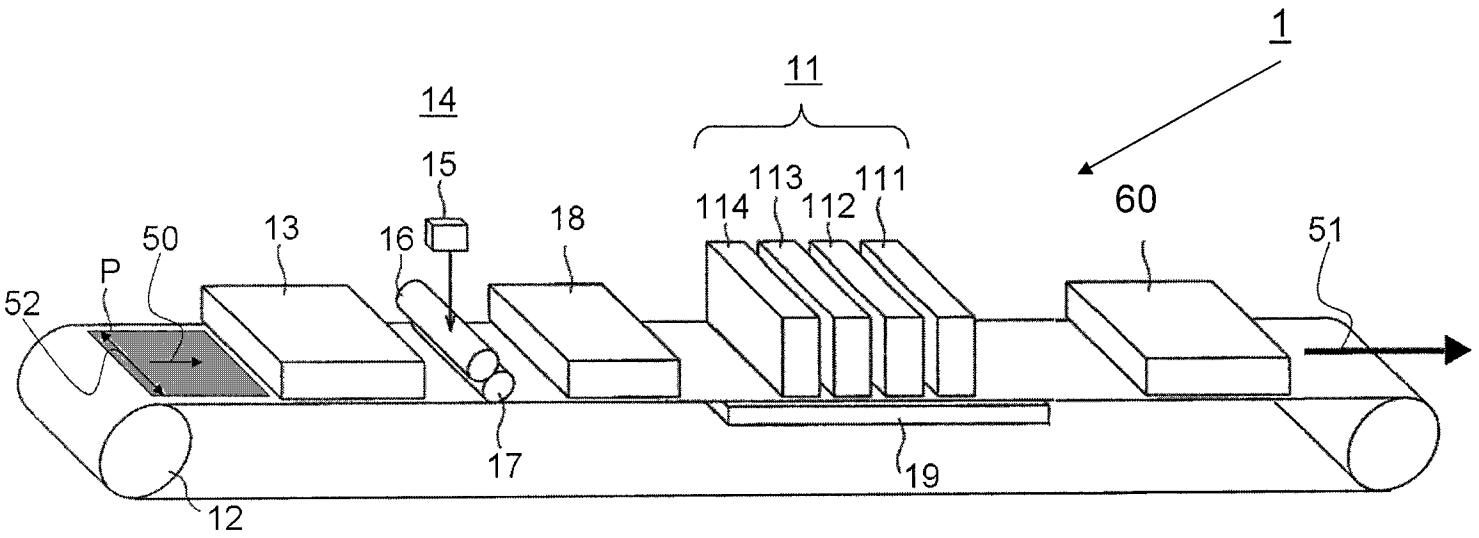
FIG. 1 shows a schematic representation of an inkjet printing system for printing sheets.

The present invention will now be described with reference to the accompanying drawings, wherein the same reference numerals have been used to identify the same or similar elements throughout the several views.

Printing Process

A printing process in which the inks according to the present invention may be suitably used is described with reference to the appended drawings shown in FIG. 1. FIG. 1 shows a schematic representation of an inkjet printing system 1.

FIG. 1 shows that a sheet of a receiving medium, in particular a machine coated medium, P, is transported in a direction for conveyance as indicated by arrows 50 and 51 and with the aid of transportation mechanism 12. Transportation mechanism 12 may be a driven belt system comprising one (as shown in FIG. 1) or more belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums. For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these vacuum fixation is preferred.

The printing process as described below comprises of the following steps: media pre-treatment, image formation, drying and fixing and optionally post treatment.

Media Pre-Treatment

To improve the spreading and pinning (i.e. fixation of pigments and water-dispersed polymer particles) of the ink on the receiving medium, in particular on slow absorbing media, such as machine coated media, the receiving medium may be pretreated, i.e. treated prior to printing an image on the medium. As an application way of the pre-treatment liquid, any conventionally known methods can be used. Specific examples of an application way include: a roller coating, an ink-jet application, a curtain coating and a spray coating. There is no specific restriction in the number of times with which the pre-treatment liquid is applied. It may be applied at one time, or it may be applied in two times or more. Application in two times or more may be preferable, since cockling of the coated printing paper can be prevented and the film formed by the surface pre-treatment liquid will produce a uniform dry surface having no wrinkle by applying in 2 steps or more.

Especially a roller coating (see 14 in FIG. 1) method is preferable because this coating method does not need to take into consideration of ejection properties and it can apply the pre-treatment liquid homogeneously to a recording medium.

FIG. 1 shows that the sheet of receiving medium P may be conveyed to and passed through a first pre-treatment module 13, which module may comprise a preheater, for example a radiation heater, a corona/plasma treatment unit, a gaseous acid treatment unit or a combination of any of the above. Optionally and subsequently, a predetermined quantity of the pre-treatment liquid is applied on the surface of the receiving medium P at pre-treatment liquid applying member 14. Specifically, the pre-treatment liquid is provided from storage tank 15 of the pre-treatment liquid to the pre-treatment liquid applying member 14 composed of double rolls 16 and 17. Each surface of the double rolls may be covered with a porous resin material such as sponge. After providing the pre-treatment liquid to auxiliary roll 16 first, the pre-treatment liquid is transferred to main roll 17, and a predetermined quantity is applied on the surface of the receiving medium P. Subsequently, the coated printing paper P on which the pre-treatment liquid was supplied may optionally be heated and dried by drying member 18 which is composed of a drying heater installed at the downstream position of the pre-treatment liquid applying member 14 in order to decrease the quantity of the water content in the pre-treatment liquid to a predetermined range. It is preferable to decrease the water content in an amount of 1.0 weight % to 30 weight % based on the total water content in the provided pre-treatment liquid provided on the receiving medium P.

To prevent the transportation mechanism 12 being contaminated with pre-treatment liquid, a cleaning unit (not shown) may be installed and/or the transportation mechanism may be comprised multiple belts or drums as described above. The latter measure prevents contamination of the upstream parts of the transportation mechanism, in particular of the transportation mechanism in the printing region.

Image Formation

Image formation is performed in such a manner that, employing an inkjet printer loaded with inkjet inks, ink droplets are ejected from the inkjet heads based on the digital signals onto a print medium.

Although both single pass inkjet printing and multi pass (i.e. scanning) inkjet printing may be used for image formation, single pass inkjet printing is preferably used since it is effective to perform high-speed printing. Single pass inkjet printing is an inkjet recording method with which ink droplets are deposited onto the receiving medium to form all pixels of the image by a single passage of a receiving medium underneath an inkjet marking module.

In FIG. 1, 11 represents an inkjet marking module comprising four inkjet marking devices, indicated with 111, 112, 113 and 114, each arranged to eject an ink of a different color (e.g. Cyan, Magenta, Yellow and blacK). The nozzle pitch of each head is e.g. about 600 dpi. In the present invention, "dpi" indicates a dot number per 2.54 cm.

FIG. 1 shows that after pre-treatment, the receiving medium P is conveyed to upstream part of the inkjet marking module 11. Then, image formation is carried out by each color ink ejecting from each inkjet marking device 111, 112, 113 and 114 arranged so that the whole width of the receiving medium P is covered.

Optionally, the image formation may be carried out while the receiving medium is temperature controlled. For this purpose a temperature control device 19 may be arranged to control the temperature of the surface of the transportation mechanism (e.g. belt or drum) underneath the inkjet marking module 11. The temperature control device 19 may be used to control the surface temperature of the receiving medium P, for example in the range of 30° C. to 60° C. The temperature control device 19 may comprise heaters, such as radiation heaters, and a cooling means, for example a cold blast, in order to control the surface temperature of the receiving medium within said range. Subsequently and while printing, the receiving medium P is conveyed to the down stream part of the inkjet marking module 11.

Drying and Fixing

After an image has been formed on the receiving medium, the prints have to be dried and the image has to be fixed onto the receiving medium. Drying comprises the evaporation of solvents, in particular those solvents that have poor absorption characteristics with respect to the selected receiving medium.

FIG. 1 schematically shows a drying and fixing unit 60, which may comprise a heater, for example a radiation heater. After an image has been formed, the print is conveyed to and passed through the drying and fixing unit 60. The print is heated such that solvents present in the printed image, to a large extent water, evaporate. The speed of evaporation and hence drying may be enhanced by increasing the air refresh rate in the drying and fixing unit 60. Simultaneously, film formation of the ink occurs, because the prints are heated to a temperature above the minimum film formation temperature (MFT). The residence time of the print in the drying and fixing unit 60 and the temperature at which the drying and fixing unit 60 operates are optimized, such that when the print leaves the drying and fixing unit 60 a dry and robust print has been obtained. As described above, the transportation mechanism 12 in the fixing and drying unit 60 may be separated from the transportation mechanism of the pretreatment and printing section of the printing apparatus and may comprise a belt or a drum.

Post Treatment

To increase the print robustness or other properties of a print, such as gloss level, the print may be post treated, which is an optional step in the printing process.

Defect Detection

Figure 2:
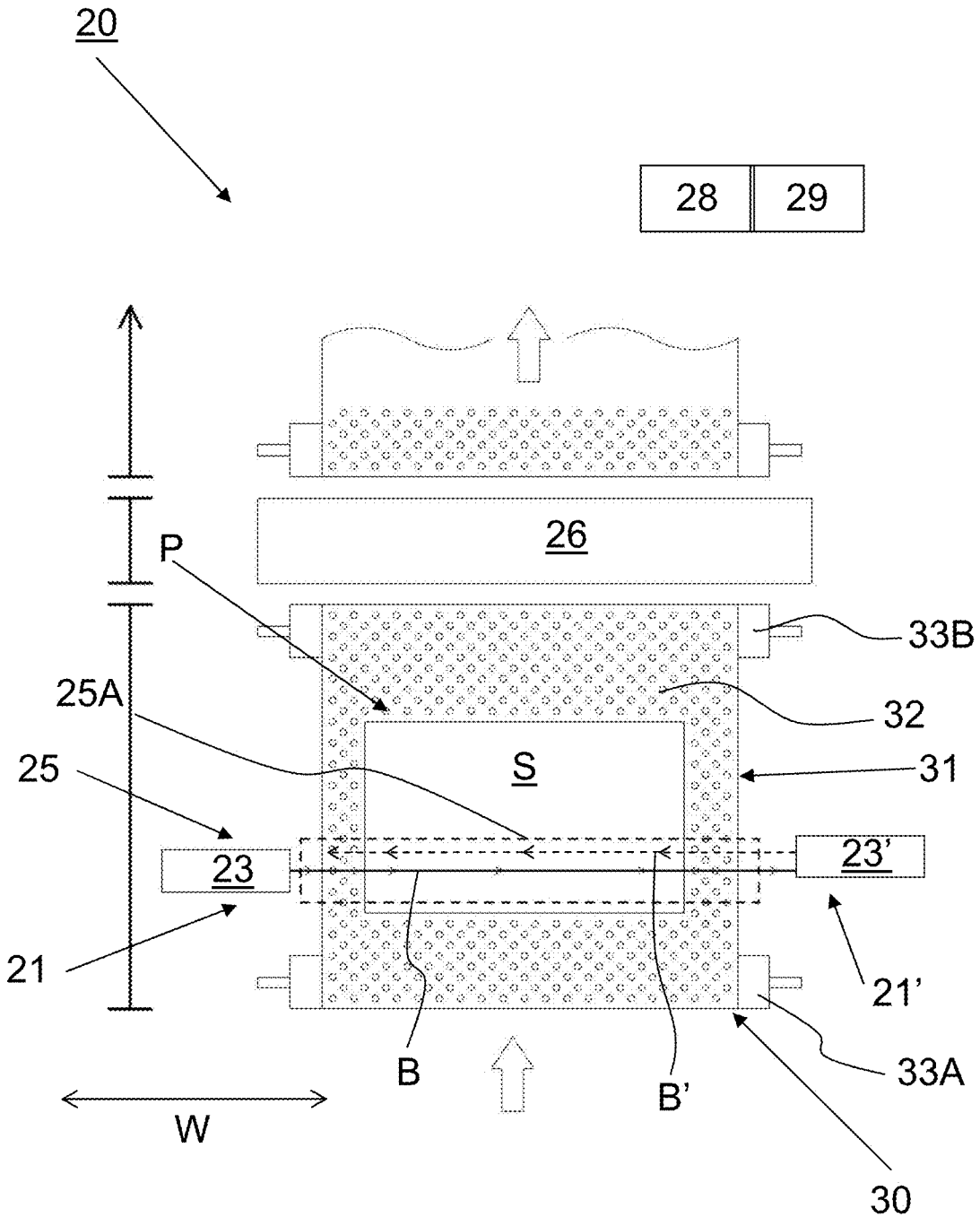
FIG. 2 shows a schematic top view of an apparatus for defect detection in a printing system according to the present invention.

With reference now to FIG. 2 of the drawings, the inkjet printing system 1 according to the preferred embodiment of the invention is shown to include an apparatus 20 for detecting defects in the printing system 1, and particularly for identifying deformations D in the sheets S of print medium when the sheets S are on the transport path P of the printing system 1. In this particular embodiment, the apparatus 20 comprises a sensing unit 21, which processes the sheets S on the transport path P before those sheets S enter the image forming device 11. In this regard, it will be noted that the printing system 1 in FIGS. 1 and 6 has a transport path P which includes both a simplex path SP and a duplex path DP and the sensing unit 21 of the apparatus 20 is arranged such that sheets S input on the simplex path SP and also returning on the duplex path DP all pass via the sensing unit 21.

When performing the sensing or measuring of the surface geometry or topology of the sheets S on the transport path P of printing system 1 with the sensing unit 21, it is highly desirable for the purposes of accuracy and reliability that the sheets S are transported or conveyed in the sensing unit 21 in substantially the same manner as those sheets S are later transported in the image forming unit or inkjet marking module 11. To this end, the sensing unit 21 includes a sheet conveyor mechanism 30 that simulates the sheet transport conditions provided by the transport mechanism within the inkjet marking module 11. In this regard, both the conveyor mechanism 30 and the transport mechanism include a belt transport device 31 with vacuum sheet-holding pressure, as seen in FIG. 2. The transport mechanism 30 comprises a pair of rotatable support rollers 33A, 33B for driving the movement of the endless belt member 31. The belt member 31 is provided with a plurality of vacuum holes or perforations through which air may be sucked to a suction system (not shown). The sheets S are held by suction against the medium support surface 32 of the transport mechanism 30 in a manner identical to that during printing. The manner of transport, i.e. the configuration of the transport mechanism (materials, dimensions, vacuum hole pattern, etc.), the transport speed, and/or the suction force are preferably similar or identical to those in the inkjet marking module 11. Additionally, the sensing unit 21 may comprise atmospheric control means to maintain the atmospheric conditions (such as temperature, humidity, etc.) in the sensing unit 31 similar to those in the inkjet marking module 11.

The sensing unit 21 comprises a first and a second emitter 23, 23' positioned on opposite sides of the sheet sensing transport path P formed by the belt member 31, though in another embodiment of the present invention the emitters 23, 23' may be positioned on the same side of the transport path P. The optical emitters 23, 23' are arranged for emitting an optical emission signal or beam B, B' at a predefined height or distance over the medium support surface 32. In FIG. 2, the preferably collimated light beam B, B' are aligned in the lateral direction W. Each emitter 23, 23' emits its beam B, B' substantially parallel to the medium support surface 32. The predefined height of each beam B, B' is selected such that said beam B, B' travels unimpeded over the sheet S on the medium support surface 32 when said sheet S is substantially free of defects or deformations (or when said deformations do not exceed a predefined height). However, when a deformation in the sheet S extends sufficiently upwards from the medium support surface 32 to come into contact with one of the beams B, B', light from said beam B, B' is reflected or scattered in other directions than the lateral direction W. A portion of the reflected light is then directed upwards.

To receive a portion of the light reflected of a deformation, the sensing unit 21 comprises a sensor assembly 25 extending in the lateral direction W over the medium support surface 32 of the transport mechanism 30. The sensor assembly 25 comprises at least one first sensor device 25A in the form of an optical sensor 25A, such as an optical line scanner, laser scanner, or light sensitive diode. The sensor assembly 25 is provided within the sensing unit 21 for sensing the surface geometry or topology of the sheets S as they travel on a first pass or a second pass along the transport path P. The one or more optical sensor devices 25A in the sensor assembly 25 generate sensor data indicative of deformations in the three-dimensional surface geometry or topology of each sheet S sensed or scanned. The first sensor devices 25A are positioned beside one another in the lateral direction W. Each first sensor device 25A in this lateral array then corresponds to a lateral range or position (e.g. a portion of the width of transport path P). When a first sensor device 25A receives light reflected of a deformation, the lateral position (or an indication thereof) of said deformation can be derived from the data generated by the one or more first sensor devices 25A, as the lateral position of the respective first device sensor device 25A is stored in the processor 29.

Figure 3A:
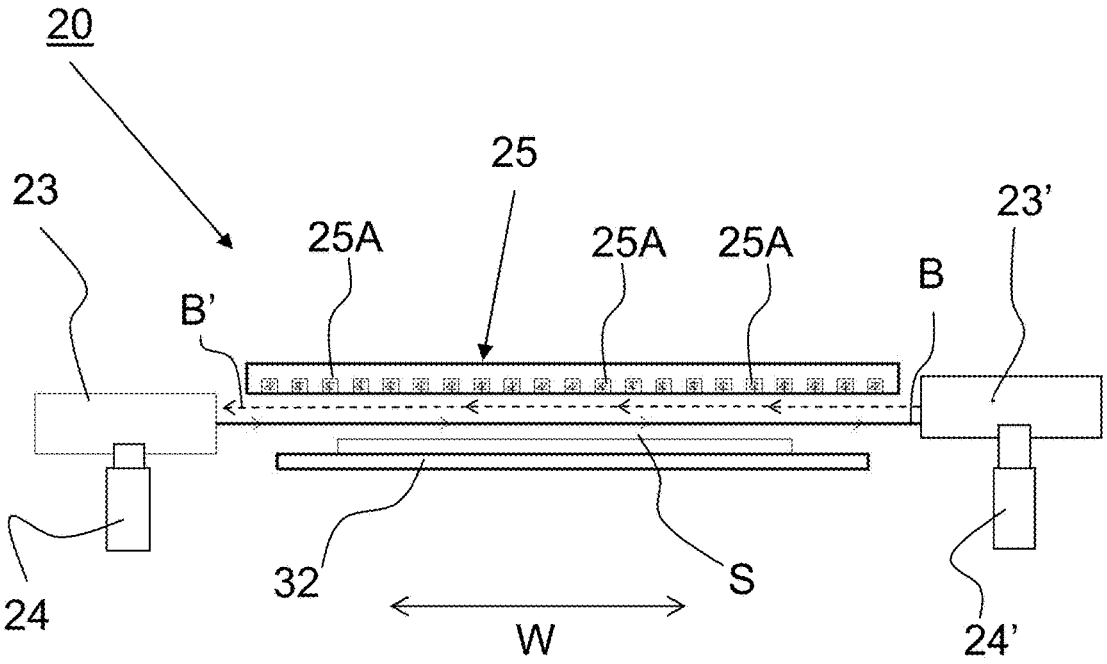
FIGS. 3A-3B show a schematic side view of the apparatus in FIG. 2 during operation for: 3A) a sheet suitable for printing and 3B) a sheet unsuitable for printing.
Figure 3B:
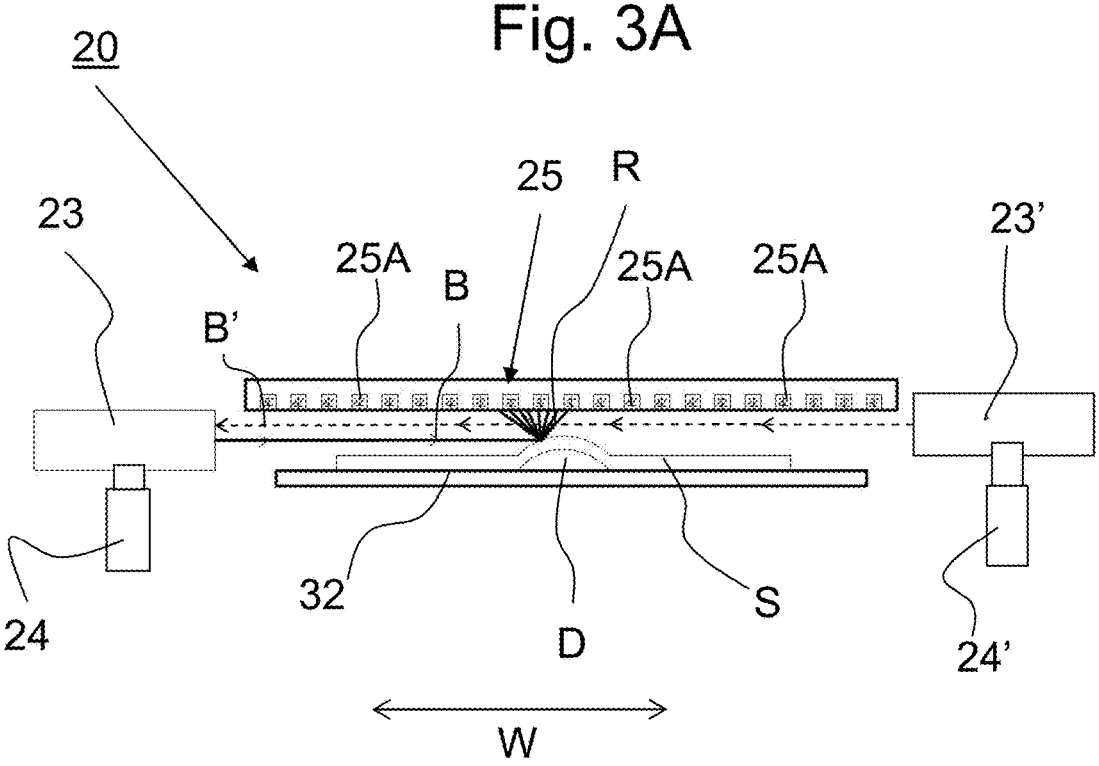

The workings of the sensing unit 21 are illustrated in FIGS. 3A and 3B. FIG. 3A shows a cross-section of the sensing 21 unit taken perpendicular to the transport direction D. The sheet S is supported on and held against the medium support surface 32. Each emitter 23, 23' is provided with its own actuator 24, 24' for adjusting or setting the height of the first emitter 23, 23' with respect to the plane 32 of sheet sensing transport path P. Thereby the distance between the medium support surface 32 and the respective emitted optical beam B, B' may be selected and set.

As can be seen in FIGS. 3A and 3B, the controller 28 sets the height of the first emitter 23 at a first height setting or position different from that of the second emitter 23'. As such the first beam B during use extends above or below the path of second light beam B'. Above and below (or higher and lower) are herein measured in a direction perpendicular to the sheet sensing transport path P. The height of each emitter 23, 23' defines or determines a sheet rejection threshold. In the embodiment shown in FIGS. 3A and 3B, the emitters 23, 23' are positioned relatively near one another in the transport direction, resulting in a compact apparatus 20 wherein a single sensor assembly 25 may be applied. It is however within the scope of the present invention to space the emitters 23, 23' relatively far apart from another, such that each may interact with its own sensor assembly 25 without interference between the emitter-sensor assembly pairs. In the compact embodiment in FIGS. 3A and 3B, the controller 28 is configured to activate or enable only one 23 of the emitters 23, 23' while sensing a sheet S. The other one of the emitters 23' is disabled as indicated by the dashed line B'.

Which of the emitters 23, 23' is enabled for sensing a sheet is determined by the controller 28 based on the state of each sheet S. In one example, the media type of the sheet S determines which one of the emitters 23, 23' is enabled for sensing a sheet S. In another example, the position of the sheet S determines which emitter 23, 23' is designated to a sheet S. A sheet on a simplex or first pass along the emitters 23, 23' is designated to be sensed by the first emitter 23, while a sheet on a duplex or second pass is designated to be sensed by the second emitter 23'. Thereby, the controller 28 applies different rejection thresholds or criteria to different sheets S. When a sheet S is assigned for double sided printing, the criteria applied during the simplex pass are preferably stricter than those on the duplex pass, as after duplex printing the sheet's remaining transport path length is brief compared to that of the same sheet S after simplex printing on its first side. This may be achieved by designating the emitter 23 with the lower height or threshold to the sheet S on its simplex pass. The blank or unprinted sheet S then passes the enabled first emitter 23, while the higher positioned second emitter 23' is disabled. It will appreciated that the controller 28 preferably selects the height of the first and second emitter 23, 23' and of the beams B, B' based on media information provided by the printing system 1, for example in the form of a media catalogue from which the medium S is selected. Aside from the media thickness or type, the current spacing of the print head gap in the inkjet marking module 11 may be taken into account in selecting the heights of the first and second emitters 23, 23'.

In FIG. 3A, the sheet S on its first pass (SP in FIG. 6) is free of deformations and both of the beams B, B' are able to extend freely through the volume between the sheet S and the sensor assembly 25 without a signal light being received by the sensor assembly 25. Note that only the first emitter 23 is enabled on the first pass of the sheet S. The beams B, B' are parallel to the plane of the medium support surface 32. Substantially no light from the first or second emitter 23, 23' is directed onto one or more of the first sensor devices 25A of the sensor assembly 25. A signal or intensity below a predefined light intensity threshold then identifies a sheet S as suitable for printing. To improve the accuracy, the sensing unit 21 may be optically shielded to prevent ambient light from entering the sensing unit 21. When the sensor assembly 25 receives no reflected light, the sheet S is deemed suitable for printing and will be passed on to the inkjet marking module 11.

FIG. 3B illustrates another sheet S on its first pass SP towards the inkjet marking module 11. In FIG. 3B, the sheet S on its simplex pass SP comprises a deformation D. The deformation D extends vertically beyond the selected emission height of the first emitter 23 and thus into the path of the beam B. The emission signal or beam B is then reflected by the deformation D. Part of the reflected light R is directed to the sensor assembly 25. One or more first sensor devices 25A receive portions of the reflected light R, though in different intensities. In accordance with the received intensities of the sensor devices 25A, the sensor assembly 25 generates sensor data. The sensor assembly 25 then transmits said data to the processor 29, which receives said sensor data and determines the suitability of the sheet S for printing from said sensor data.

The sensor data or deformation data from the sensor assembly 25 is then transmitted (e.g. either via a cable connection or wirelessly) to a controller 28 which includes a processor 29 for processing and analysing the digital image data to detect any defect or deformation D in the surface geometry or topology of each sensed sheet S. A reference or minimum intensity threshold may be provided for each first sensor device 25A to eliminate unwanted signal from noise such as background lighting. When the processor 29 determines that said threshold has been exceeded for one or more first sensor devices 25A, the processor 29 determines the sheet S to be unsuitable for printing. The sensing unit 21 is thus arranged to scan the sheets S for detecting and measuring any deformations or defects D before the sheets S enter the image forming device or inkjet marking module 11. In this way, if the processor 29 determines that a sheet S on the transport path P includes a defect or deformation D that would render the sheet unsuitable for printing, the controller 28 is configured to prevent the sheet S from progressing to the inkjet marking module 11.

To prevent unsuitable sheets S from reaching the inkjet marking module 11, the sensing unit 21 is therefore desirably provided as a separate sentry unit 21 positioned on the transport path P sufficiently upstream of the inkjet marking module 11. The controller 28 and processor 29 may be integrated within the sentry unit 21 or they may be separately or remotely located. The apparatus 20 according to the present invention further comprises a removal device 26 or ejector device 26 shown in FIG. 5 for directing a sheet S from the transport path P to a rejection transport path before said sheet S reaches the inkjet marking module 11. The removal device 26 may be a transport switch 26 controlled by the controller 28. When the processors 29 determines that a sheet S is unsuitable for printing based on the data from the sensing unit 21, the controller 28 controls the removal device 26 to direct said sheet S from the transport path P onto a rejection transport path RP leading to a reject output tray.

In consequence, the sheet S in FIG. 3B is ejected on its simplex pass SP. Were the sheet S in FIG. 3B on its duplex pass (DP in FIG. 5), the second emitter 23' with the higher threshold setting would have enabled while the first emitter was disabled. The beam B' would then have passed over the deformation D and the sheet S on its duplex pass DP would have been deemed suitable for printing and passed to the inkjet marking module 11 and from there to the output path (OP in FIG. 5). It will be appreciated that the different emitters may also be selectively enabled based on sheet type, thickness, and/or material. In an alternative embodiment, all emitters are enabled when the stricter rejection criterion is applied (e.g. during the simplex pass), but only the higher lying emitter is enabled during e.g. the duplex pass.

Figure 4:
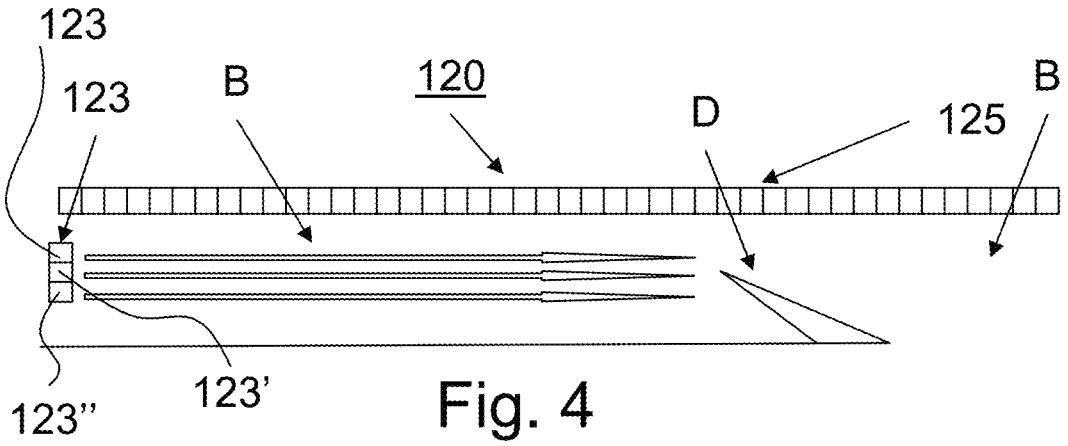
FIG. 4 shows schematic representation of a further embodiment an apparatus for defect detection in a printing system according to the present invention.

FIG. 4 illustrates another embodiment of an apparatus 120 according to the present invention. The sensor assembly 125 is configured similar to FIGS. 2-4. The plurality of emitters 123, 123', 123" are all positioned on one lateral side of the sheet sensing transport path P. The emitters 123, 123', 123" are positioned or secured at different heights above the transport path P, either manually or by means of actuators. Using multiple emitters 123, 123', 123" enables setting different rejection thresholds when multiple different media types are applied. Further, one of the emitters 123, 123', 123" may be adjusted in height, while the other emitters 123, 123', 123" continue operating. As such the printing system 1 need not be halted for threshold adjustments. The latter principle may also be applied for two emitters 23, 23' as in FIGS. 3A and 3B.

Figure 5:
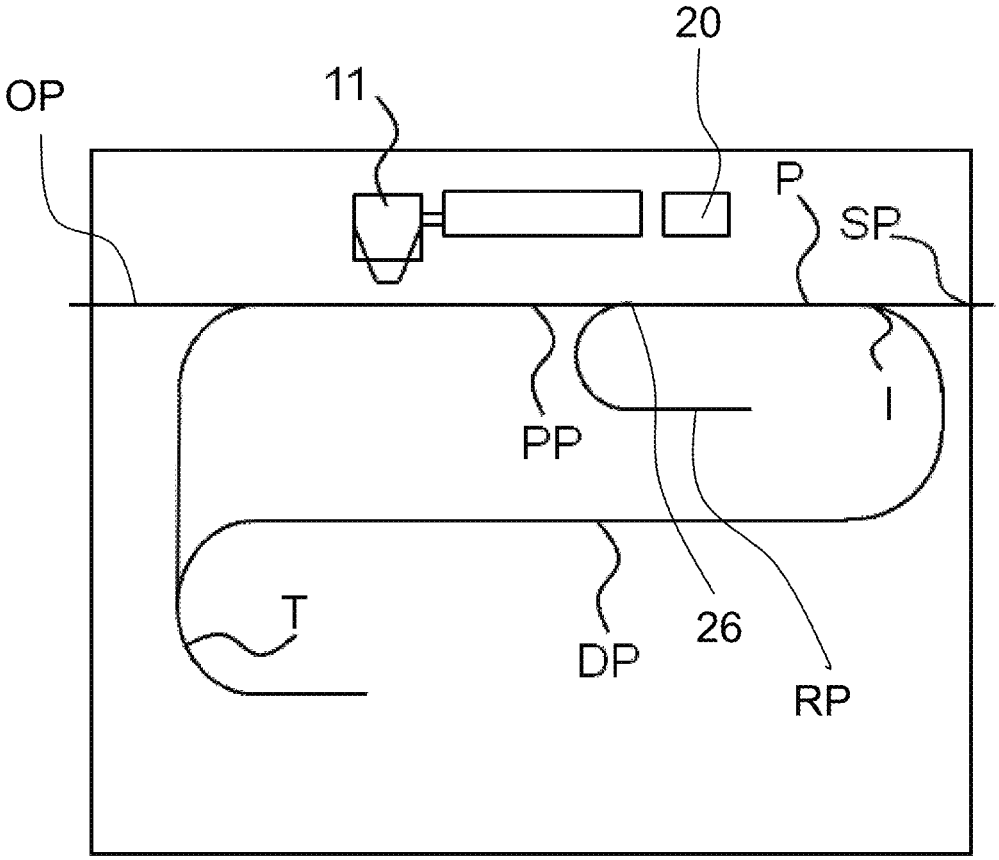
FIG. 5 shows schematic representation of the simplex and duplex transport passes of the printing system in FIG. 1.

FIG. 5 schematically illustrates the transport path of the printing system 1. Sheets S are fed from a sheet feeder (not shown) onto the simplex path SP from where they travel towards the apparatus 20. After sensing by the apparatus 20, suitable sheets S pass to the print head 11, while unsuitable sheets S are ejected via the removal switch 26 to the reject transport path RP. After simplex printing, sheets S are either output via output path OP or returned to the print head 11 via the duplex pass DP. The duplex pass DP comprises a turning station T for flipping a sheet S with its unprinted side towards the print head 11. The controller 28 is configured to determine the state of each sheet S. The state may be determined by the position of the sheet S, specifically whether said sheet S is on the simplex SP or duplex pass DP. The state may further be determined by the media type of the sheet S.

Print System Control

Figure 6:
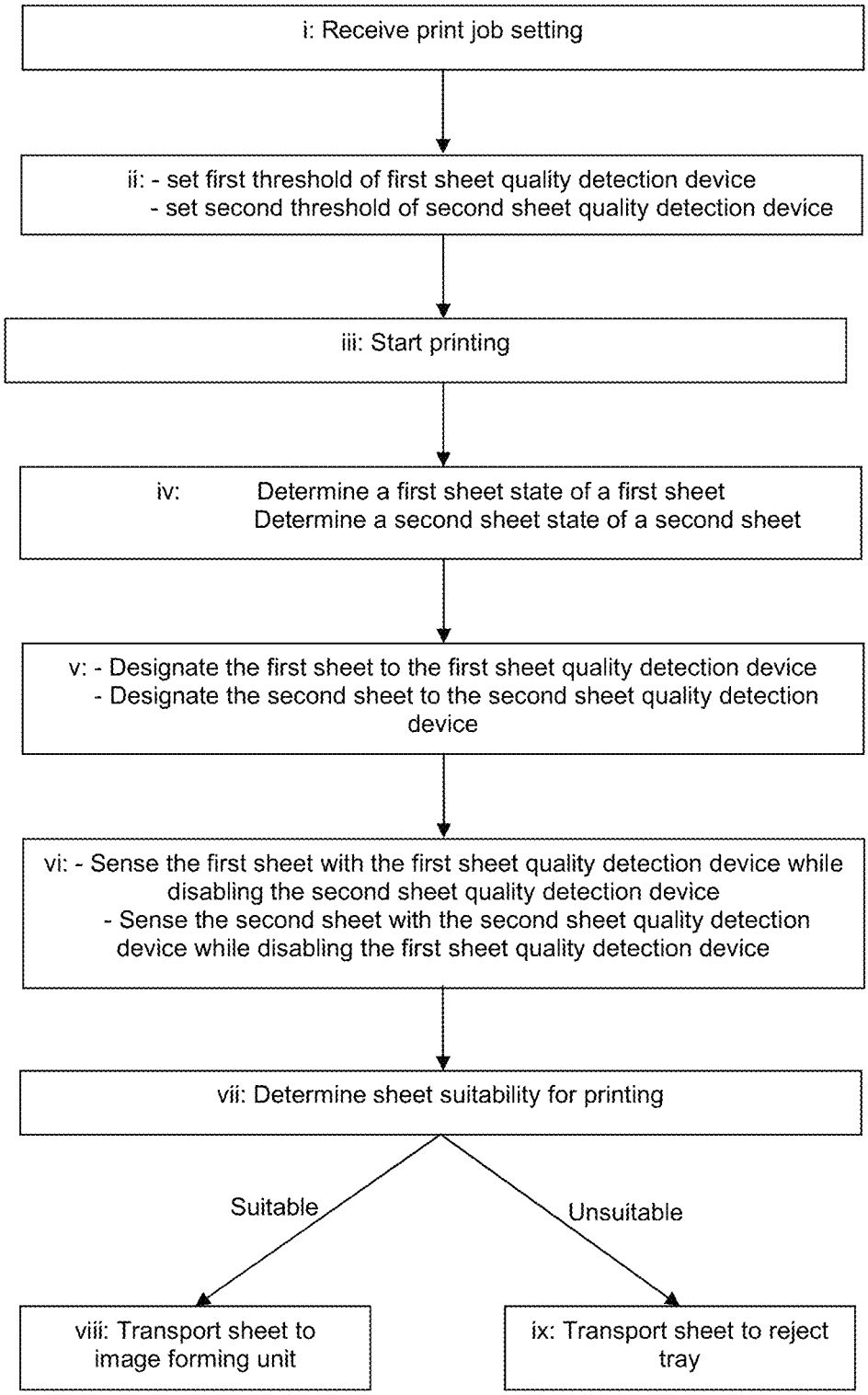
FIG. 6 shows a schematic diagram with the steps of a method for according to the present invention.

Referring now to FIG. 6 of the drawings, a flow diagram is shown that schematically illustrates the steps in a method of detecting defects in a printing system 1 according to the preferred embodiment of the invention described above with respect to FIGS. 1 to 5.

In step i, the controller 28 receives the print job settings via a user interface. The print job settings preferably comprise information regarding the media to be used and/or image information, specifically simplex-duplex information. From the print job settings, the controller 28 determines a first sheet rejection threshold for a first state or type of sheets S, and if a second state or type of sheets S is required for the print job, a second sheet rejection threshold for the second state type of sheets S. The controller 28 preferably distinguishes sheet state types by e.g. simplex-duplex images and/or media type.

In step ii, the controller 28 controls the first and second actuators 24, 24' to set the first and second emitters 23, 23' at their respective heights corresponding to the first and second sheet rejection thresholds. The first emitter 23 is thereby positioned at a first height below the second emitter 23', such that the first sheet rejection threshold is set stricter than the second, or vice versa.

In step iii, the controller 28 starts printing, wherein sheets S are fed from a sheet feeder to the image forming unit 11. The sheets S in step iv are classified into one of the plurality of sheet state types, i.e. a sheet state parameter is assigned to the individual sheets S in correspondence to e.g. their position or media type.

For each sheet S in the printing system 1, in step v the controller 28 designates one of the first and second emitters 23, 23' associated with the respective sheet state type or parameter. The first emitter 23 for example is designated to sheets S with the first sheet state type while the sheets S with the other sheet state type are assigned to the second emitter 23'.

The controller 28 in step vi controls the apparatus to sense a sheet S. If the sheet S is of the first sheet state type, the controller 23 activates the first emitter 23 and disables 23' the second emitter 23'. The second beam B' is eliminated. The sheet S of the first sheet state type then passes the first beam B set at the first sheet rejection threshold height. The latter sheet S is thereby compared to the first sheet rejection threshold and if the sensor assembly 25 detects sufficient signal, the sheet S is rejected to the reject transport path RP. When a sheet S of the second sheet state type is on the sheet sensing transport path P, the controller disables the first emitter 23 and enables the second emitter 23' to emit the second beam B' at the second sheet rejection threshold height. Thereby, the latter sheet S is compared to the second sheet rejection threshold. This allows sheets S of different sheet state types to be compared to different sheet rejection thresholds without requiring a physical modification of the apparatus 20. This is particularly advantageous in high productivity sheet printing wherein sheets S may pass the image forming unit at speeds of 300 sheets per minute or higher. Especially in a printing system 1 wherein simplex and duplex sheets S are interleaved to alternately pass the apparatus 20, physically adjusting the height of the emitter 23, 23' between each pair of simplex and duplex sheets S would reduce the productivity due to the time required to reposition the emitter 23, 23'.

The apparatus 20 generates data based on which the controller 28 determines the sheet's suitability for printing in step vii. Unsuitable sheets S are rejected in step ix, while suitable sheets S are printed on.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An apparatus for defect detection in a sheet printing system, comprising:

a sheet sensing transport path;

a first and a second sheet quality detection device positioned along the sheet sensing transport path and configured for sensing sheets on the sheet sensing transport path, the first and second sheet quality detection devices defining respectively a first and a second sheet rejection threshold to which a sensed sheet is compared for determining its suitability for printing;

a controller configured to designate each sheet in a print job on each pass of a sheet over the sheet sensing transport path to one of the first and the second sheet quality detection devices, such that each sheet is sensed by its designated one of the first and the second sheet quality detection devices.

2. The apparatus according claim 1, wherein during use the first sheet rejection threshold is set different from the second sheet rejection threshold.

3. The apparatus according to claim 1, wherein the first and second sheet quality detection devices comprise respectively a first and a second threshold setting actuator for adjusting and setting respectively the first and second sheet rejection thresholds independently of one another.

4. The apparatus according to claim 1, wherein the controller is configured to disable one of the first and the second sheet quality detection devices when the other one of the first and the second sheet quality detection devices senses a sheet to which said other one of the first sheet and a second quality detection devices is designated.

5. The apparatus according to claim 1, wherein the controller is configured to determine a sheet state parameter for each sheet for each pass of said sheet over the sheet sensing transport path, and wherein the controller designates the one of the first and second sheet quality detection devices based on said sheet state parameter.

6. The apparatus according to claim 5, wherein the sheet state parameter comprises:

a simplex-duplex parameter corresponding to the respective sheet being on a simplex pass or duplex pass of the printing system; and/or a media type parameter corresponding to the media type of the respective sheet.

7. The apparatus according to claim 1, wherein the first and the second sheet quality detection devices comprise respectively a first and a second emitter for emitting respectively a first and a second emission signal towards a sheet on the sheet sensing transport path.

8. The apparatus according to claim 7, wherein the first and the second emitters are configured for emitting respectively the first and the second emission signals parallel to a plane of the sheet sensing transport path.

9. The apparatus according to claim 7, wherein the first and second threshold setting actuators are configured to adjust a height of respectively the first and the second emitters perpendicular to the plane of the sheet sensing transport path.

10. The apparatus according to claim 9, further comprising a sensor assembly positioned with respect to the first and the second emitter such that:

the first and/or the second emission signals is prevented from reaching the sensor assembly when the sheet is suitable for printing; and at least part of the first and/or the second emission signals is reflected from the sheet to the sensor assembly when a deformation in the sheet exceeds respectively the first and/or the second sheet rejection threshold.

11. The apparatus according to claim 1, further comprising:

a processor to determine the suitability of the sheet for printing from sensor data generated by the sensor assembly and representative of a deformation in the medium;

wherein the controller is configured for controlling further progress of the sheet along the transport path in dependence of the determined sheet's suitability for printing;

a removal device for removing the sheet from the transport path of the printing system, wherein the controller is configured to control the removal device to remove the sheet from the transport path if the processor determines the sheet to be unsuitable for printing.

12. A printing system comprising the apparatus according to claim 1 and a simplex pass for first-sided printing of sheets and a duplex pass for second-sided printing sheets, wherein the controller is configured to designate sheets on their simplex pass to the first sheet quality detection device and to designate sheets on their duplex pass to the second sheet quality detection device.

13. A method for detecting defects in sheets in a printing system, comprising a first and a second sheet quality detection device positioned along the sheet sensing transport path and configured for sensing sheets on the sheet sensing transport path of the printing system, the first and second sheet quality detection devices defining respectively a first and a second sheet rejection threshold, the method comprising the steps of:

designating a first sheet in a first state to the first second quality detection device;

the first sheet quality detection device sensing the first sheet;

designating a second sheet in a second state different from the first state to the second sheet quality detection device; and the second sheet quality detection device sensing the second sheet.

14. The method according to claim 13, further comprising the steps of:

comparing the sensed first sheet to the first sheet rejection threshold to determine whether the first sheet is suitable for printing;

comparing the sensed second sheet to the second sheet rejection threshold to determine whether the second sheet is suitable for printing; and ejecting sheets deemed unsuitable for printing from a transport path of the printing system.

15. The method according to claim 13, further comprising the steps of:

inputting print job settings to a controller; and the controller controlling a first and a second threshold setting actuator to set respectively the first and the second sheet rejection threshold of respectively the first and the second sheet quality detection device.

* * * * *